United States Patent [19]

Moyer

[11] Patent Number: 4,746,318

[45] Date of Patent: May 24, 1988

[54] MATERNITY EXERCISE GARMENT

[76] Inventor: Nanette C. Moyer, 940 Alma Place, Oakland, Calif. 94610

[21] Appl. No.: 91,204

[22] Filed: Aug. 31, 1987

[51] Int. Cl.[4] ..... A41C 1/08

[52] U.S. Cl. ..... 450/155; 450/7; 450/96; 450/116

[58] Field of Search ..... 450/155, 7, 8, 93, 94, 450/95, 96, 113, 116; 2/44

[56] References Cited

U.S. PATENT DOCUMENTS

| | | | |
|---|---|---|---|
| 284,831 | 9/1883 | Galny | 450/155 X |
| 880,444 | 2/1908 | Donaldson | 450/155 X |
| 2,617,990 | 11/1952 | Allard | 450/155 |
| 2,743,449 | 5/1956 | Sheldon | 2/44 |
| 3,273,563 | 9/1966 | Bonang | 450/155 |
| 3,282,264 | 11/1966 | Connelly | 450/155 |
| 3,357,435 | 12/1967 | Ehrico | 450/007 |
| 3,756,247 | 10/1973 | Hand | 450/155 X |
| 4,005,715 | 2/1977 | Moore | 450/155 |
| 4,494,546 | 1/1985 | Steiman | 450/7 |

*Primary Examiner*—Louis K. Rimrodt
*Assistant Examiner*—J. L. Olds
*Attorney, Agent, or Firm*—Phillips, Moore, Lempio & Finley

[57] ABSTRACT

An exercise garment especially adapted for use by expectant mothers consists of an abdominal and breast support band that surrounds and supports the uterine area and includes breast support cups. The abdominal and breast support band is of double thickness elastic material and is affixed to a pair of elastic tights. It also includes shoulder straps that cross in the back and are fixed to the breast support cups on the side in the vicinity of the waistline. Also included is a sternum band.

11 Claims, 2 Drawing Sheets

MATERNITY EXERCISE GARMENT

TECHNICAL FIELD

This invention relates to an exercise garment and in particular relates to an exercise garment that is adapted for use by pregnant women.

BACKGROUND

In recent years, exercise has become a daily part of most individual's lives. It may, for example, take the form of jogging, walking, bicycling, or aerobic exercises. In years past when a woman became pregnant, the consensus was that she must avoid strenuous exercise. More recently, this advice has been tempered and it is not uncommon for a pregnant woman to participate in relatively strenuous exercise programs, and in particular, aerobic exercise. Not only has exercise benefitted the woman but it may very well have a salutary effect on the unborn child.

The effects of exercise on the woman are immediately apparent and continue through the birth and subsequent recovery. It appears that exercise activity during a pregnancy is highly beneficial and in most cases is recommended.

The problem with such a program is that the physiology of a woman's body during pregnancy is constantly changing and growing. In particular the growth of the fetus adds a mass in the abdominal area. Concurrently, the woman's breasts become enlarged in anticipation of the birth of the child and the subsequent breast feeding. During exercise, the enlarged abdomen and enlarged breasts require extra support, otherwise the woman may feel discomfort both during and after the exercise session.

Presently, there are available support belts that pass under the uterine area principally to prevent sagging. Usually these uterine support belts include shoulder straps such that the support is actually provided from the shoulder. While such a structure would probably be adequate for an active woman, were she to select walking as an exercise regimen, it would be inadequate for a more active type of exercise such as aerobics, principally because the only support is to prevent sagging. Further, the support band type structure only becomes operable in the latter stages of pregnancy when the uterine area is greatly enlarged relative to the non-pregnant woman. Finally, the abdominal support bands do not provide concurrent breast support. Thus, the more active pregnant woman, were she to elect the abdominal support-type structure would have to combine it with conventional breast support found in a brassiere.

In participating in aerobic exercises, it is usual for the participant to wear tights which are a skin fitting pant structure starting at the waist and extending to the vicinity of the ankles with some tights having foot straps to ensure that the legs of the tights don't work up ones legs as one exercises. In addition, the participant usually wears a leotard over the tights. While some definitions would indicate a leotard included ankle length legs along with the close fitting garment for the torso, the commonly accepted definition of a leotard is a garment covering the torso which may or may not have arms, but does not include legs. Returning to the tights, it is well known that the tights manufactured for a non-pregnant woman would not be satisfactory for the pregnant woman as the expanded abdomen would be too tightly constricted. Garments such as tights, skirts and so forth that are made for pregnant women generally have an opening in the front with a draw string around the waist. Such a structure allows for the growing abdomen. Further, such tights have no support whatsoever for the abdomen. Nor, for that matter, would a conventional leotard. It is possible that the prior art abdominal supporters described above could be used with a leotard or tights but such would prove cumbersome and probably would not be satisfactory for the active exerciser. Furthermore, it is likely the tights would not fit as least during the third trimester of pregnancy.

Prior art maternity support devices usually use straps, lacing, buckles or hook and eye Velcro type fasteners to compensate for the growing abdomen. While such adjustable straps, buckles and so on permit use of the garment for a period of time, they are inconvenient and result in chafing and irritation, particularly during an aerobic exercise session. Further, such support belts and the like may prove unsightly to the user even though some outer garment is included.

It is thus an object of this invention to provide an exercise garment for pregnant women which supports the abdominal area while concurrently providing breast support.

It is a further object of this invention to provide an exercise garment for pregnant women which may be utilized throughout the period of pregnancy without discomfort.

It is also an object of this invention to provide an exercise garment which provides a pleasing profile to the pregnant woman without the appearance of unsightly straps, snaps, buckles or the like.

It is still a further object of this invention to provide an exercise garment that may be worn under additional pieces of clothing.

SUMMARY OF THE INVENTION

The objects of this invention are attained by providing an elasticized elongated abdominal and breast support garment comprising a support band formed to pass around the uterine area with the band narrowing and crossing over itself at the base of the sternum of the wearer and than widening to form breast cups, the bands then narrowing again to form straps that pass over the user's shoulders with the straps crossing at mid back. The ends of the straps are then each affixed at the level of the base of the sternum to the opposite breast cup from which the strap emanates. The abdominal breast support garment also includes an elasticized pair of tights affixed at the upper end of the tights to the inferior side of the breast cups and fixed to the lateral and inferior sides of the band where the band passes around the uterine area.

DETAILED DESCRIPTION OF THE EMBODIMENT

Figure 1:
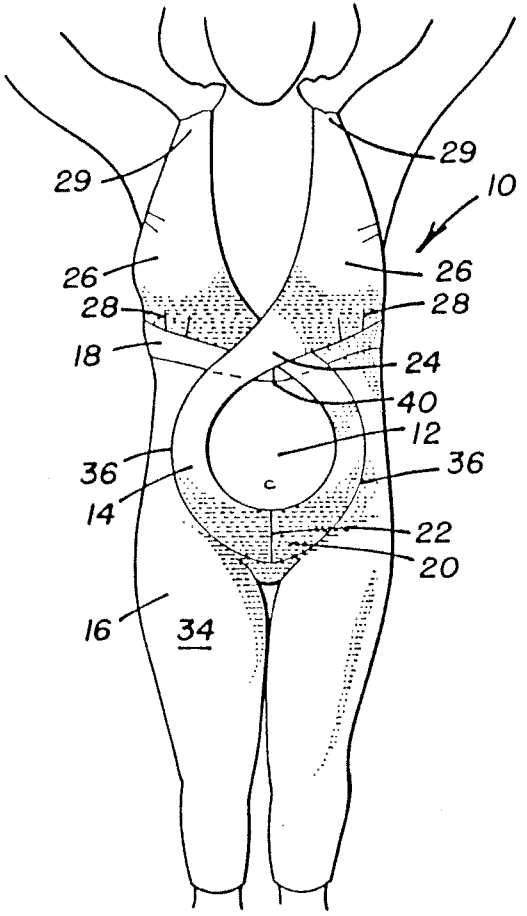
FIG. 1 is a frontal view of the exercise garment described herein as worn by a pregnant woman.

Referring to FIG. 1, an elasticized abdominal and breast support garment 10 hereinafter also referred to as exercise garment 10 is illustrated. In FIG. 1, the garment is shown in place as worn by a pregnant woman. It can be seen that the garment is particularly adapted for pregnant women as evidenced by the opening over the abdomen or uterine area 12.

The abdominal and breast support garment 10, consists of two principal parts, each having particular components and a third supplemental part that enhances the construction. These three parts are an abdominal and breast support band 14 and a specially adapted pair of tights 16. The third part which assists in the structure as will be seen from the ensuing description is a sternum band 18.

The abdominal and breast support band 14 is a band that starts in the pubic area 20 and passes around the abdomen 12 as shown in FIG. 1. While not necessary, it has been found convenient for ease of manufacturing to include a seam 22 running vertically down the lower portion of the abdomen as shown in FIG. 1 when band 14 is made in two pieces. It also should be pointed out that band 14 is preferably made of a nylon-Spandex material. Preferably 85% nylon and 15% Spandex. This material is available through a wholesaler: Impala Industries International at 321 East 32nd street, Los Angeles, Calif. 90011. It is also available from Leeds Fabrics in Los Angeles and Jerry Becker and Associates in North Hollywood, Calif. Other elasticized materials may also be used.

Band 14 is a double layer of material. It extends from the pubic area around the uterine area or abdomen 12 where the band narrows and crosses over itself at the base of the wearer's sternum 24. The individual bands then widen as they pass upwardly and over the wearer's breasts to form breast cups 26. These cups may be formed in a manner well known in the art, for example, by the use of sewn in darts 28 or any other convenient means.

The bands 14 narrow again as they pass upwardly and over of the wearer's shoulder at 29. The bands 14 then pass downwardly and cross over each other at the high mid back 30 of the wearer. The bands 14 then pass downwardly and are connected to the breast cups 26 at 32. As can be seen from FIG. 3 this connection point is at about a level with the base of the sternum of the wearer and to the cup opposite from where the straps emanate. In order to provide some adjustment, sliding buckles 33 may be interposed in bands 14. Sliding buckles 33 may be of the type used on shoulder straps of brassieres.

Fixed to band 14 is a pair of tights 34. Tights 34 are affixed to the outer or lateral sides 36 of band 14 in the uterine area or abdomen 12 and also to the inferior side of band 14 over the pubic area. Similarly, the top of the tights 34 are affixed or associated with the lower side 38, breast cups 26.

Figure 2:
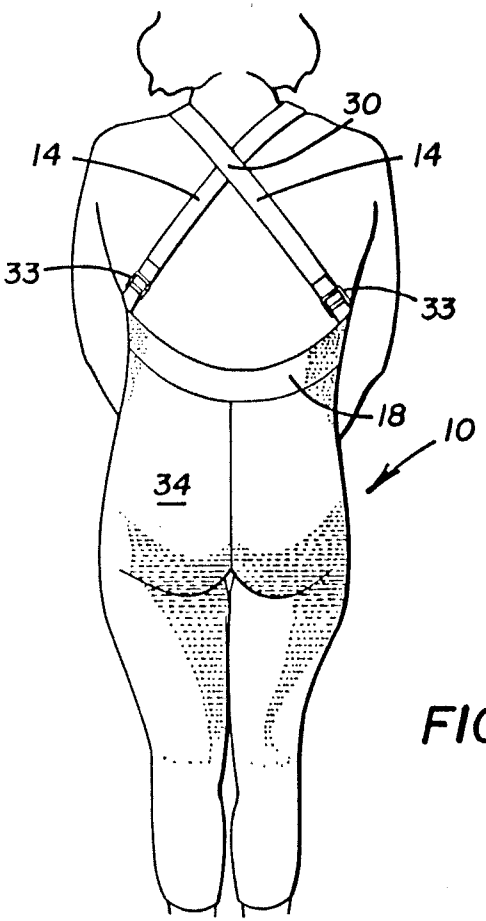
FIG. 2 is a back view of the garment shown in FIG. 1.
Figure 3:
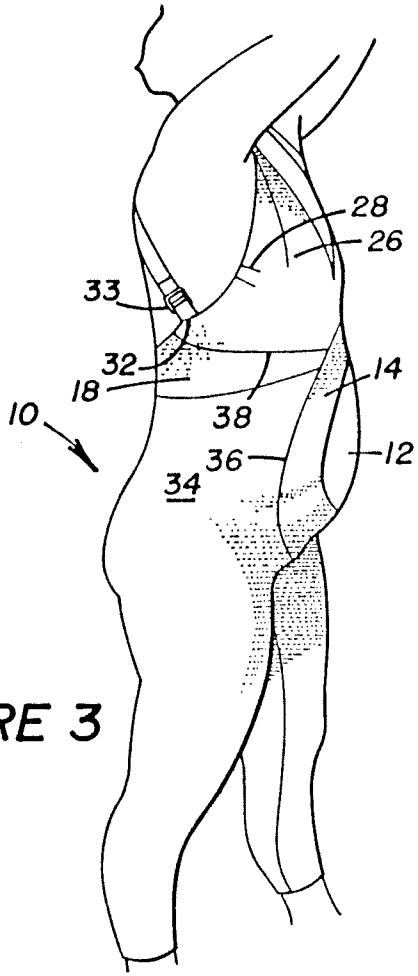
FIG. 3 is a side view of the garment shown in FIG. 1.

It has been found expedient to utilize a sternum band 18, also made of a double thickness of the same nylon Spandex combination denoted above. Sternum band 18 may be inerposed between the tights 34 and breast cups 26 as shown in FIGS. 1, 2 and 3. It should be evident from FIGS. 1, 2 and 3 that sternum band 18 surrounds the wearer and is stitched to the bottom of the breast cup 26 with the tights 34 affixed at their upper end to their inferior lower side of sternum band 18. Sternum band 18 is connected at the stomach by seam 40. It is emphasized that sternum band 18 is likewise affixed to the bands 14 at the point band 18 passes underneath band 14 where band 14 crosses over itself at the base of the wearer's sternum 24.

The area within the circle formed by band 14 over the wearers abdomen 12 is purposely left open to allow for the normal growth of the uterine area during pregnancy. By using an elasticized nylon-Spandex material in the abdomenal area the band will expand during the normal 9-month pregnancy.

As is well known during the latter stages of the pregnancy, there is also a good deal of breast expansion which again may be taken care of by the elasticized nylon Spandex material described above. By utilizing an elasticized material, the exercise garment 10 will fit the expanding breasts thereby precluding several different garments of differing breast size which would be normal with a more rigid breast support structure.

Figures 4, 5, 6, 7, 8:
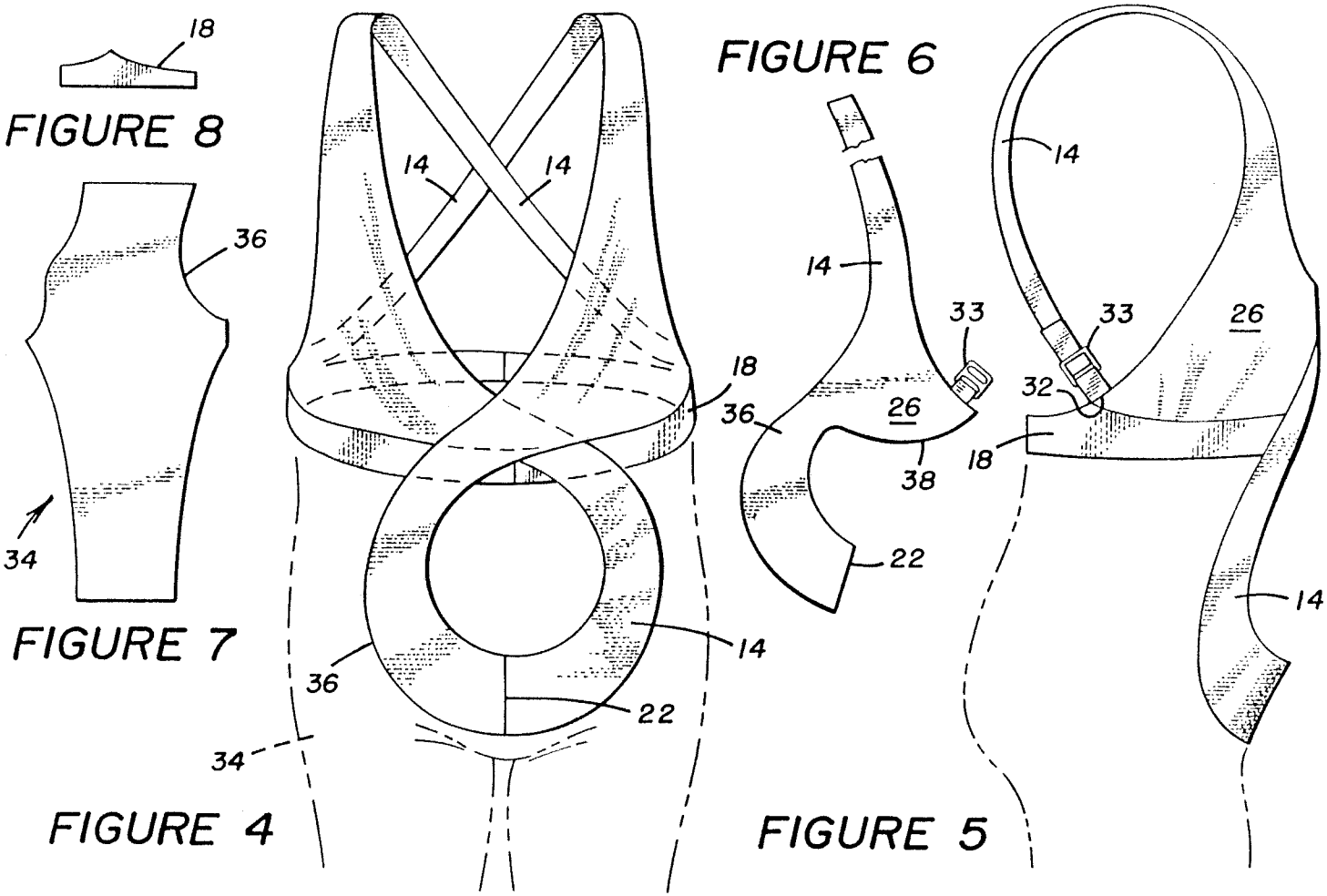
FIG. 4 is a front view of the garment as it would appear without the model.
FIG. 5 is a side view of the garment shown in FIG. 4.
FIG. 6 is a pattern view of one half of the abdominal and breast support band.
FIG. 7 is a pattern view of one leg of the tights.
FIG. 8 is a pattern view of the waistband.

Referring now to FIGS. 4–8, the garment just described can be seen in its assembled and disassebled states. In particular, FIG. 4 shows the relationship of the bands 14 as they cross in the front at the level of the base of the wearer's sternum and again as they cross at the wearer's upper mid-back. It can clearly be seen that the straps 14 are affixed to the breast cups at the level of the base of the sternum. It should be noted that the band 14 could likewise be fastened to the sternum band 18 if the sternum band 18 is incorporated into the garment.

FIG. 6 is particularly important to understand the structure of the abdominal and breast support band. It should be understood that FIG. 6 represents only one half of the structure. The two portions are affixed together at seam 22 (see FIG. 4). It should also be noted in FIG. 6 that the full length of the shoulder strap portion of band 14 is not shown.

Referring to FIGS. 7 and 8, the pattern for the tights 34 is shown in FIG. 7. As in FIG. 6, the pattern shown in FIG. 7 is for a single leg. The seam 36 affixing the leg of tights 34 to the abdominal and breast support band 14 is clearly denoted both in FIGS. 6 and 7. Likewise, the structure of the sternum band 18 is shown in FIG. 8.

Not shown is a cuff that may be added to the legs of tights 34 to better finish off the lower structure of that portion of the garment. Further, foot straps or stirrups may also be added.

In use it has been found that the band arrangement 14 provides support to the uterine area or abdomen 12 through the unique crossing of the bands 14 at the base of the sternum 24 and then passing upwardly over the breasts and over the shoulders and downwardly crossing in the back and being affixed to the lower portion of the opposite breast cups. The tights 34, or in the event that a sternum band 18 is utilized, then transmits this support from the shoulder straps through band 14 downwardly to the abdominal portion of band 14. Similarly the tights 34 serve too prevent the band 14 from riding up and over the uterine area as would be the case with prior art support devices, particularly where the band structure is unitary as is described herein. This unitary structure has eliminated the need for buckles or snaps or fasteners of any type permitting the user to step into the tights 34 and pull the garment up over abdomen 12 and waist line 24 then passing her arms through the bands 14. With the elimination of most or all of the laces, buckles and the like, the chafing that occurrs in other maternity support garments is completely eliminated. In use, the wearer may prefer using a leotard covering her body from the hips to the shoulders in a conventional manner.

The band structure 14 is particularly useful in supporting the uterine area. Not only is it supportive in a vertical manner, it also provides a certain degree of lateral support as it passes around the abdomen as shown in FIG. 1. The same support is provided in the breast cups 26 which are broad in their nature yet non-restrictive to the expanding breasts of a pregnant woman.

While this invention has been described in relation to a particular embodiment it should be limited only so far as the appended claims.

What is claimed is:

1. An elasticized abdominal and breast support garment comprising:

a support band formed to surround and support the uterine area of a wearer, the band narrowing and crossing over itself at the base of the wearer's sternum, then widening to form breast cups, then narrowing again to form straps passing over the shoulders of the wearer, the straps crossing at mid back, with the ends of each strap fixed at the level of the base of the wearer's sternum to the opposite breast cup from whence the strap emanated;

an elasticized pair of exercise tights affixed to the inferior side of the breast cups at the upper end of said tights and to the lateral and inferior sides of the support band in the abdominal area of said tights.

2. The garment of claim 1 further including:

a sternum band fixed to the inferior side of said breast cups and passing under the support band at a point where the support band that narrows and crosses over itself at the level of the wearer's sternum;

said tights affixed at their upper end to said sternum band.

3. The garment of claim 1 wherein the support band is formed of a double thickness of nylon-Spandex material.

4. The garment of claim 3 wherein in the material is 85% nylon and 15% Spandex.

5. The garment of claim 1 wherein the material used to form the garment is a mixture of 85% nylon and 15% Spandex.

6. In combination with a pair of exercise tights wherein the abdominal area is open, an abdominal and breast support band comprising:

a support band formed to surround and support the uterine area, the band narrowing and crossing over itself at the level of the base of the sternum and widening to form breast cups, the band then narrowing again to form straps passing over the wearer's shoulders, the straps crossing at the wearer's mid back with the ends of the straps each fixed at the level of the base of the sternum to the opposite breast cup from whence the strap emanated.

the exercise tights affixed to said elasticized band on the inferior side of said breast cups at the upper end of said tights and to the lateral and inferior sides of the band in the uterine area.

7. The combination of claim 6 further including a sternum band fixed in the inferior side of said breast cups and passing under the support band at a point wherein the support band narrows and crosses over itself at the level of the base of the sternum;

the exercise tights affixed at their upper end to said sternum band.

8. The combination of claim 6 wherein the support band is formed of a double thickness of nylon-Spandex material.

9. The combination of claim 8 wherein the material is 85% nylon and 15% Spandex.

10. The combination of claim 6 wherein the elastic material used to form the support band is a mixture of 85% nylon and 15% Spandex.

11. The combination of claim 10 wherein the tights are an elastic material consisting of a mixture of 85% nylon and 15% Spandex.

* * * * *